US008281542B2

(12) United States Patent
Struthers et al.

(10) Patent No.: US 8,281,542 B2
(45) Date of Patent: Oct. 9, 2012

(54) MECHANISMS FOR LOCKING AND REMOVING FLUSH MOUNTED INSERTS

(75) Inventors: Scott Struthers, San Clemente, CA (US); Ray Call, Mission Viejo, CA (US); Geoff Spencer, San Juan Capistrano, CA (US); Greg Fetter, Capistrano Beach, CA (US)

(73) Assignee: Dana Innovations, San Clemente, CA (US)

( * ) Notice: Subject to any disclaimer, the term of this patent is extended or adjusted under 35 U.S.C. 154(b) by 969 days.

(21) Appl. No.: 12/251,951

(22) Filed: Oct. 15, 2008

(65) Prior Publication Data

US 2009/0049791 A1 Feb. 26, 2009

Related U.S. Application Data

(63) Continuation-in-part of application No. 12/202,870, filed on Sep. 2, 2008, now Pat. No. 8,209,921, which is a continuation-in-part of application No. 11/954,667, filed on Dec. 12, 2007, now Pat. No. 7,461,483, which is a continuation- in- part of application No. 11/566,365, filed on Dec. 4, 2006, now Pat. No. 7,699,138.

(60) Provisional application No. 60/950,237, filed on Jul. 17, 2007, provisional application No. 60/825,162, filed on Sep. 11, 2006.

(51) Int. Cl.
*E04B 1/00* (2006.01)

(52) U.S. Cl. ..... 52/741.4; 52/742.11

(58) Field of Classification Search ..... 52/741.4, 52/220.8, 747.1, 742.11; 381/345
See application file for complete search history.

(56) References Cited

U.S. PATENT DOCUMENTS

| | | | | |
|---|---|---|---|---|
| 4,460,947 | A | 7/1984 | Kelly | |
| 4,890,418 | A | 1/1990 | Sachs | |
| 5,152,559 | A | 10/1992 | Henrichs | |
| 5,485,733 | A | 1/1996 | Hoffman | |
| 5,641,298 | A | 6/1997 | Holloway | |
| 6,637,707 | B1 | 10/2003 | Gates et al. | |
| 6,705,139 | B2 | 3/2004 | Tsai | |
| 6,750,398 | B1 | 6/2004 | Richardson | |
| 7,292,702 | B2 * | 11/2007 | Hagman | 381/345 |
| 7,461,483 | B2 * | 12/2008 | Struthers et al. | 52/204.1 |
| 2003/0150190 | A1 | 8/2003 | Schroth | |
| 2007/0051862 | A1 | 3/2007 | Monti | |

FOREIGN PATENT DOCUMENTS

| | | |
|---|---|---|
| WO | 2006106555 | 10/2006 |

* cited by examiner

*Primary Examiner* — Basil Katcheves
(74) *Attorney, Agent, or Firm* — Fish & Associates, PC

(57) ABSTRACT

A wall-mounted component can be flush-mounted into a wallboard by first installing a panel with a receiver bracket flush into a wallboard. Once the panel is installed, the component can be inserted into the receiver bracket at which point a locking mechanism automatically or manually engages to lock the component into the wall. The locking mechanism is concealed from view so that a casual observer does not see how the component is affixed to the wall, yet is accessible from the wall's exterior for routine service and maintenance, as well as reinstallation of updated components.

14 Claims, 18 Drawing Sheets

MECHANISMS FOR LOCKING AND REMOVING FLUSH MOUNTED INSERTS

This application is a continuation-in-part of non-provisional application Ser. No. 12/202,870 filed Sep. 2, 2008. Ser. No. 12/202,870 is a continuation-in-part of non-provisional application Ser. No. 11/954,667 filed Dec. 12, 2007. Ser. No. 11/954,667 is a continuation-in-part of non-provisional application Ser. No. 11/566,365 filed Dec. 4, 2006, and Ser. No. 11/954,667 also claims priority to (1) provisional application Ser. No. 60/950,237 filed Jul. 17, 2007 and (2) International application Ser. No. PCT/US07/16404 filed Jul. 19, 2007. Ser. No. 11/566,365 claims priority to provisional application Ser. No. 60/825,162 filed Sep. 11, 2006. PCT/US07/16404 claims priority to (1) non-provisional application Ser. No. 11/548,381 filed Oct. 11, 2006, (2) provisional application 60/825,162 filed Sep. 11, 2006, and (3) provisional application 60/950,237 filed Jul. 17, 2007. All prior applications are incorporated by reference in their entirety.

FIELD OF THE INVENTION

The field of the invention is locking mechanisms for wall and ceiling receptacles.

BACKGROUND

Plasma screens, speakers, light switches, electrical outlets, recessed lighting, junction boxes and other components are conventionally mounted to walls or ceilings. Components are generally held in place on a bracket using some sort of attachment mechanism. When those components break down or need to be replaced, however, the attachment mechanism oftentimes needs to be removed in order to service the component.

U.S. Pat. No. 5,152,559 to Henrichs teaches a hook and latch mechanism for a wall panel, where the wall panel locks into place as it is installed on a wall bracket, and a large button in the center of the panel releases the latch so that the panel can be removed. Having a visible unlocking device, however, can detract from the aesthetic appeal and elegance of high-end wall mounts, and advertises the mechanism by which the component is affixed to the wallboard. Henrichs and all other extrinsic materials identified herein are incorporated by reference in their entirety. Where a definition or use of a term in an incorporated reference is inconsistent or contrary to the definition of that term provided herein, the definition of that term provided herein applies and the definition of that term in the reference does not apply.

US 2007/0051862 to Monti teaches a wall-mounted speaker with protrusions that lock into indentations in a bracket in only one direction. There is no visible unlocking device, as the wall-mounted speaker unlocks by pushing the speaker through the wall to the other side. While the protrusion/indentation mechanism in Monti effectively locks the speaker in place within the bracket without a visible unlocking mechanism, the speaker can only be unlocked by pushing the speaker through to the other side of the wall. Such a configuration is not ideal for many installations where access to the other side of the wall is not available. Additionally, an owner of the speaker may want only authorized persons to detach the speaker from the wall.

Thus, there is still a need in the art for locking mechanisms for wall mounts that do not have a visible unlocking mechanism, and can be pulled out from the wallboard.

SUMMARY OF THE INVENTION

The present invention provides apparatus and methods in which a component is installed into a wallboard receiver by locking the wall component to the receiver using a concealed locking device. Typically, a wallboard is a building board made for surfacing rather than for insulating ceilings and walls. Wallboards are often made into large rigid sheets that are fastened to the frame of a building to provide a surface finish. As used herein, the term "wallboard" should be construed broadly to mean any sort of mechanical barrier for surfacing ceilings or walls. Wallboards can be made of any suitable material, including for example plywood, plaster, wood, wood pulp, or gypsum.

The component is locked to the receiver using a locking mechanism that prevents the component from being removed from the receiver, and preferably completely immobilizes the component with respect to the receiver. Suitable locking mechanisms include matching magnets, magnet attractors, indents, detents, compressible material, sliding bolts, recesses, pivoting latches, latch locks, screws and threaded holes. Matching parts of a locking mechanism are two parts that mate with one another to prevent the component from being removed from the receiver. Preferably, the locking mechanism comprises several matching magnets and magnet attractors on the component and the receiver. A magnet attractor is defined herein as any material that has a positive magnetic susceptibility. Contemplated magnet attractors include iron, lodestone, steel, nickel, cobalt, and magnetite. A magnet attractor is attracted to a magnet when placed in close proximity to the magnet, which means that either the magnet is pulled towards the magnet attractor or vice versa. Preferred matching magnets and magnet attractors pull the component into the receiver without any additional forces when the magnets are located within 1, 2, or even 5 inches away from one another. (2.54, 5.08, and 12.7 cm)

Whatever the locking mechanism, a cover preferably conceals the locking mechanism from being viewed from a typical viewing angle. This can be accomplished by physically placing or sliding a cover over the locking mechanism, but is typically accomplished by placing the locking mechanism on any side but the front side of the component. A key could be used engage the locking mechanism, however, the locking mechanism preferably automatically engages as the component slides into the receiver so that a user looking at the front of the component does not see how the component is attached to the receiver.

An electronic remote could unlock the locking mechanism, for example a radio frequency transmitter or a passive RFID tag, but the key to unlock the component from the receiver is preferably a low tech solution. For example, a magnet could slide a bolt or latch to the side, or a screwdriver could unscrew a bolt running through the component and the receiver. A user could also simply overpower the locking mechanism by pulling the component from the receiver using a gripping surface, for example a handle, outcropping, or a loop. Where the front surface of the component is without a gripping surface, a vacuum or magnetic force could be used. Vacuum grippers could provide a powerful vacuum force by combining a lever with a suction cup, and electromagnets or lodestones could provide a powerful magnetic force.

The bracket is preferably located within a panel that is installed in the wallboard for ease of installation. Preferred panels have compositions and thicknesses that match the wallboard to which they are being finished, in terms of thickness, composition, and so forth. Where there are differences in composition or thickness, it is preferred that the moisture absorption rate and the thermal expansion rate of the panel and the wallboard differ by no more than 30%, 20%, 10% or 5% from one another to prevent cracking and fraying. Contemplated panel materials include polymers, plasters, woods, fiberboards, and gypsum. Since the panel will likely be anchored to a support structure using a screw, nail, or similar attachment mechanism, preferred panels have a plurality of screw hole positions, for example depressions, markings, or screw holes, that indicate potential screw or nail positions. Panels can have factory cut openings that receive the multiple receivers, and in such cases the receivers would likely be glued to the panel material to eliminate any gaps. More advantageously, the panel material can be molded around the receivers so that there is essentially no gap between panel material and receivers.

A receiver can be affixed to an opening in the panel, which typically extends from a front side of the panel to the back side of the panel. Receivers can range from a simple rim disposed on the inside of the opening to an extensive bracket and housing extending out the back of the panel. In any event, completed assemblies preferably have little or no discernable gap between the panel and the receiver. This can be accomplished in any suitable manner, including for example, accurately cutting the opening into which the receiver is installed and then gluing the receiver to the panel. Where the panel comprises a formed substance such as drywall, another option is to form the panel around the receiver.

In preferred embodiments, a receiver has a spackle shield that covers the opening, which can include useful installation tools, for example a level, installation screws, or installation instructions. In the figures, each receiver also has an optional spackle rim that extends outwardly from the front surface of the panel by a small distance. Preferred distances are less than ½ inch (1.27 cm), more preferably by only ⅛ inch (3.175 mm), and even more preferably 1/16 inch (1.5875 mm). Spackling compounds can then be smoothed over the surface of the wallboard and panel up to the spackle rims to achieve a contiguous visual appearance. While the surface of the wallboard is typically flat, the junction between the wallboard and the panel does not necessarily have to be flat.

Panels are typically installed into the wallboard by first approximating the edges of the panel with the edges of the wallboard. "Approximating" is defined herein to mean bringing the edges near or towards one another so that the junction or gap between the edges is less than 10 mm (0.394 in), 5 mm (0.197 in), or even 2 mm (0.079 in). If the junction or gap between the edges is larger, a buffer can be attached to the edge of the panel before installation, or one or more shims can be installed into the junction. The junction can then be concealed using a suitable construction method, for example taping or plastering over the junction. Providing a pre-fabricated panel designed to accept specific components greatly facilitates installation by eliminating the need for on-site precision measurements.

All types of components are contemplated for installation, but especially including components having electrical parts. For example, speakers, lights, switches, wall plugs, in-wall controls (audio, video, fan), thermostats (HVAC controllers), fire sprinklers, fire alarms and smoke alarms, mirrors, video screens, kitchen appliances, picture frames, signage, intercoms, air vents, vacuum outlets, security panels, and iPod docks and ports are all contemplated components.

The contemplated locking mechanisms allow a user to easily service a component in a wallboard while concealing the locking mechanism from view, facilitating the elegant flush-mounted appearance. As defined herein, "servicing" means installing, uninstalling, or otherwise maintaining the component and/or receiver.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
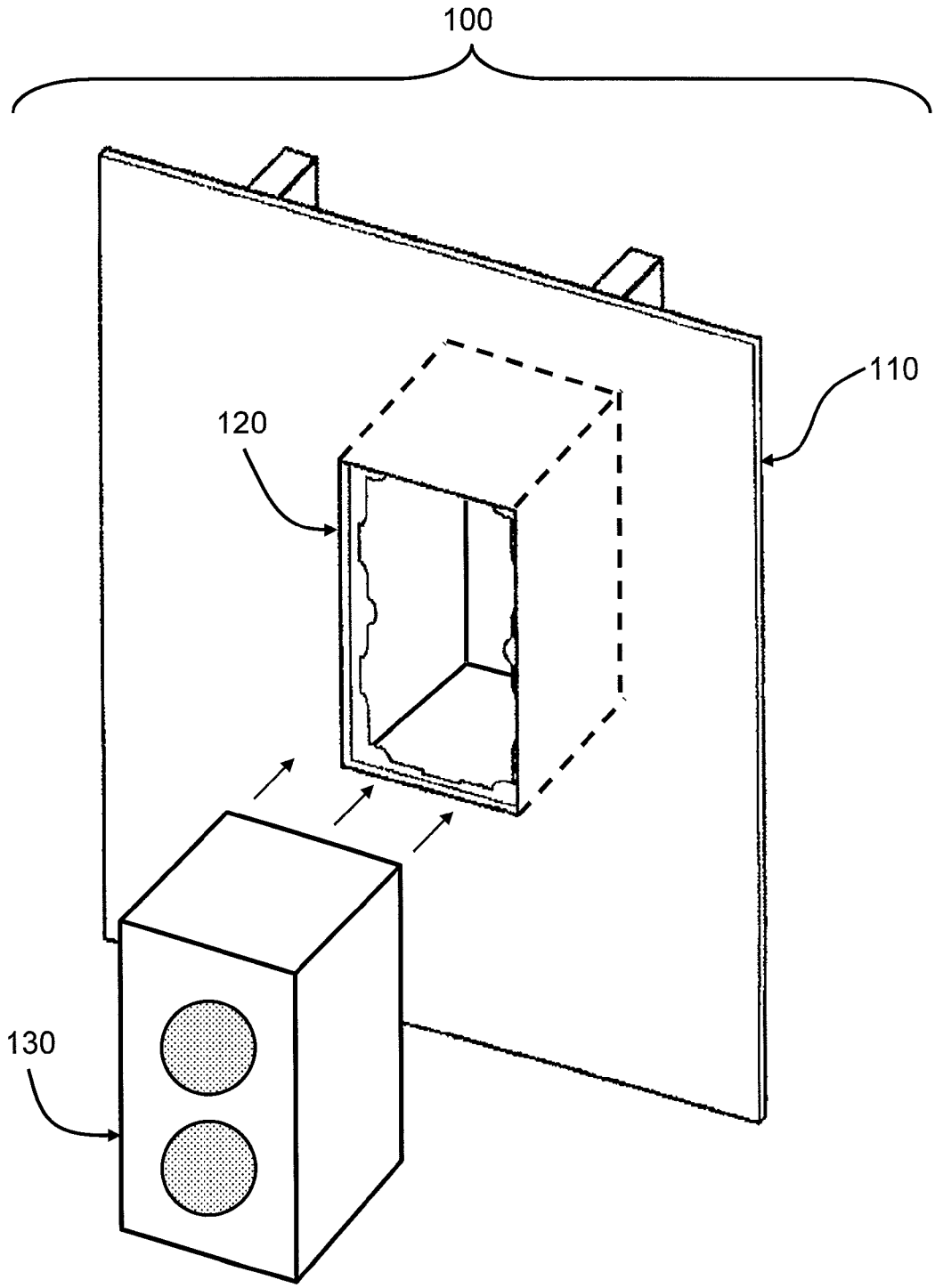
FIG. 1 is a front perspective view of a component and a matching receiver in a wallboard.

In FIG. 1, a component mounting system 100 generally includes a wallboard 110, a receiver 120, and a component 130. It should be appreciated that while component 130 is a speaker, any suitable component mounted to a wall could be used, for example plasma screens, in wall art panels, in wall cabinets, windows, wall outlets, security systems, fuse boxes, light switches, lighting, sprinkler systems, smoke detectors, and so forth. While the receiver is generally shaped and sized to fit particular electronic devices, for example a rectangle for a light switch or a circle for a ceiling light, the universal receiver may be used that can accommodate a variety of electronic devices. To fit the component to a universal receiver, the component could consist of an outer casing that fits around the electronic device and couples to the universal receiver.

Figure 2:
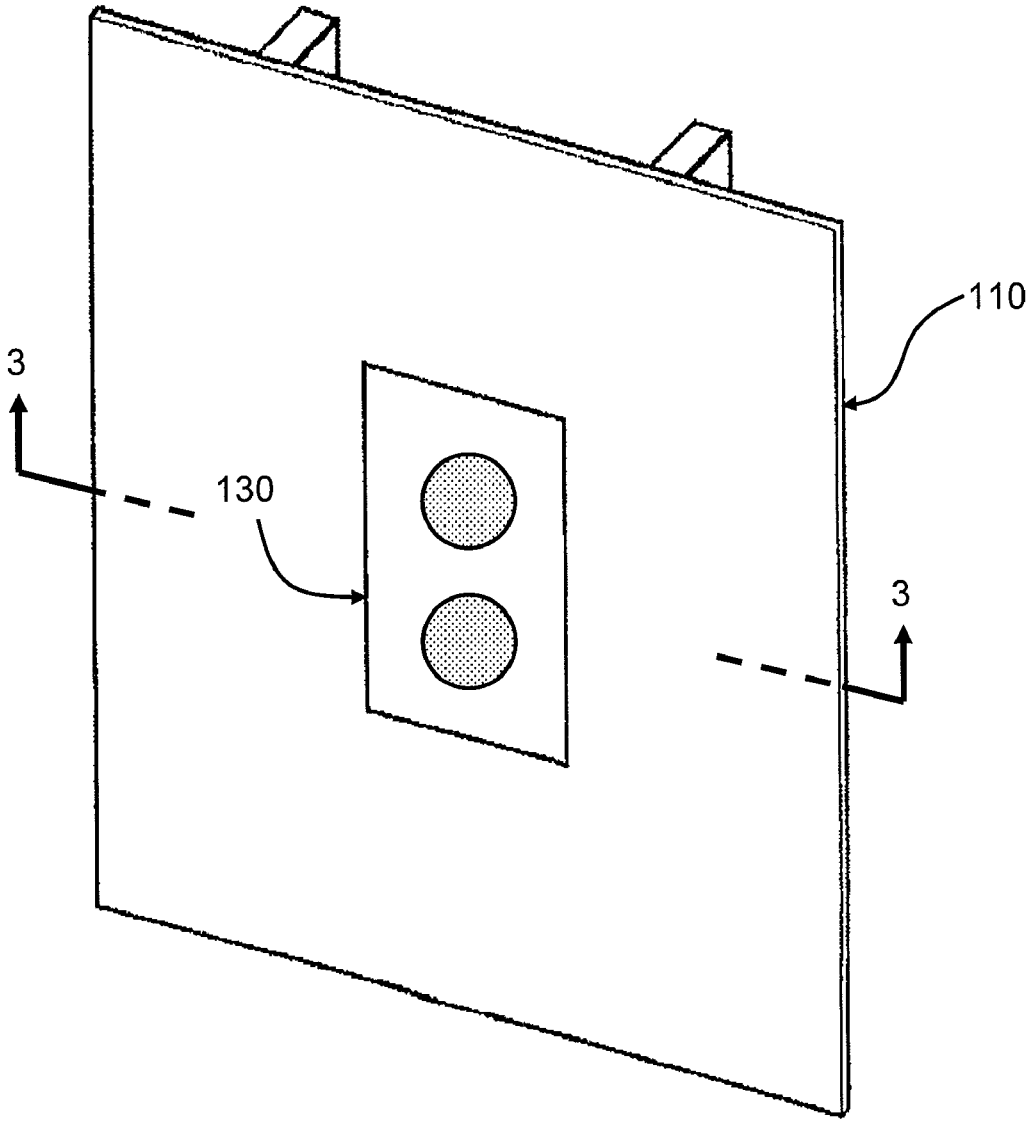
FIG. 2 is a front perspective view of the component mounted in the matching receiver of FIG. 1.

As shown in FIG. 2, component 130 can be inserted into receiver 120 to create a flush-mounted appearance within wallboard 110. Flush-mounting means to make a surface of the component substantially flush with the surface of the wallboard. Although the portions of the wallboard 110 depicted in the FIG. 2 is substantially flat, those skilled in the art will appreciate that the structure could be curved, slanted, or have curved/slanted portions in any direction. Preferably, a locking mechanism (not shown) locks component 130 to receiver 120 to prevent the component from being removed from the receiver. In an exemplary embodiment, the locking mechanism completely immobilizes component 130 within receiver 120 until the locking mechanism is disengaged. The locking mechanism is hidden from view once the component is installed in the receiver so as not to disturb the elegant flush-mounted Contemplated locking mechanisms are disclosed in FIGS. 3-10, and are discussed in detail below.

Figure 3A:
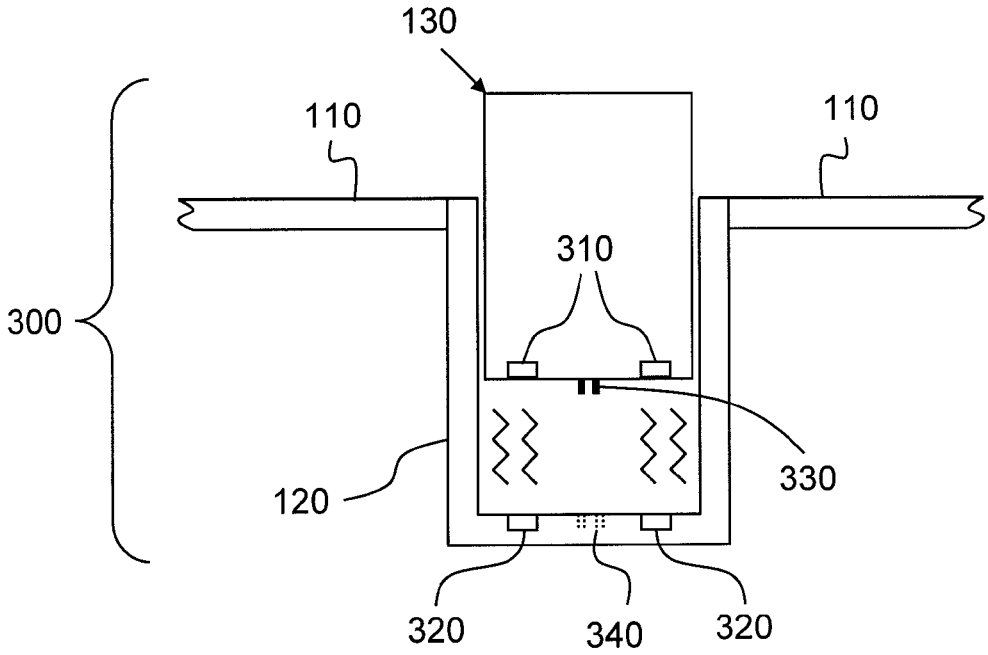
FIGS. 3A-3B are simplified horizontal cross-sections of the component and receiver of FIG. 2, taken along line 3-3.
Figure 3B:
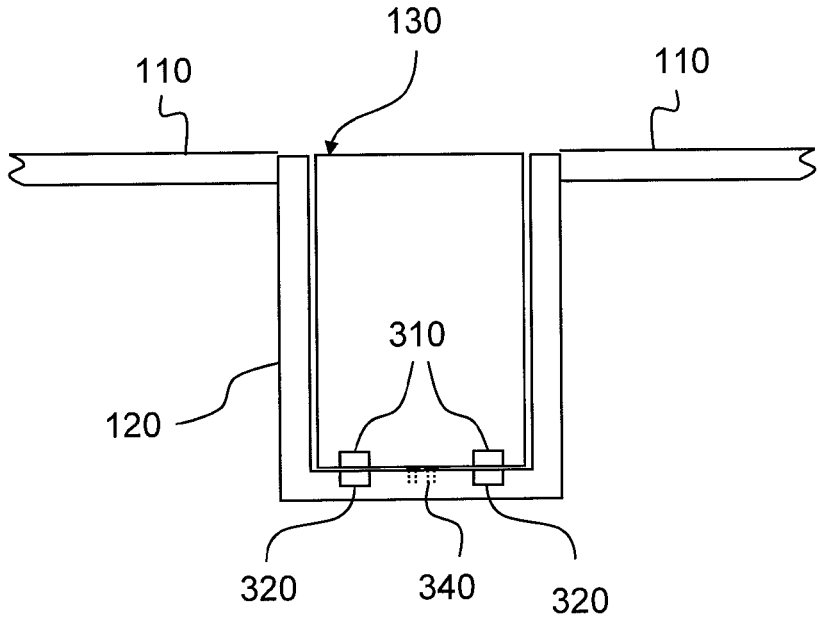

In FIGS. 3A and 3B, a magnet locking mechanism 300 generally comprises magnet attractors 310 and magnets 320. Magnets 320 pull component 130 into receiver 120 so that the front portion of component 130 is flush with the front of wallboard 110. While magnets 320 do not have to be particularly strong, magnets 320 are preferably strong enough to pull component 130 into the locked position when magnets 320 are less than 5 inches (12.7 cm), 2 inches (5.08 cm), or 1 inch (2.54 cm) from magnet attractors 310. It should be appreciated that magnet attractors 310 could be switched with magnets 320, or could be magnets themselves. In a preferred embodiment, magnet attractors 310 are magnets, and magnets 320 are electromagnets. A remote control (not shown) could then reverse the polarity of magnets 320 to "eject" the component from the receiver when maintenance needs to be performed. Alternatively, a wire (not shown) could run to the front of component 130 and surround magnet attractors 310 so that when a current is applied to the wire, the magnet attractors 310 reverse polarity to "eject" the component from the receiver.

Component 130 has electrical male connectors 330 are banana jacks that are sized, spaced, and oriented to mate with electrical female connectors 340 as component 130 is being mounted in receiver 120. Banana couplings are preferred because they provide a particularly robust connection, and it is relatively easy to orient the plug to the jack. Of course, one could use a single plug and jack provided that a proper electrical pathway is established, for example, an RF connector. All other suitable types of connectors are also contemplated, including for example inductive connections (not shown), simple bent wire or other bump connectors (not shown), loudspeaker connectors (not shown), D-sub connectors (not shown), and combinations thereof. It should be appreciated that male connectors 330 and female connectors 340 could be switched with one another without departing from the scope of the invention.

Regardless of the type of connectors and manner of providing the electrical connections, it is preferred that the electrical connection is a substantially automatic. As the component is mounted in the receiver, the female electrical connectors 340 should mate with the male electrical connectors 330 without a separate act. In FIG. 3A and 3B, as component 130 is placed within receiver 120, the magnetic force of magnets 320 upon magnet attractors 310 pulls male electrical connectors 330 into female electrical connectors 340. Forcing the user to manually mate the connectors in a separate act, whether with a WIRE-NUT™ or otherwise, is thought to be much less preferable.

It should be appreciated that electrical connectors may not need to be installed at all, particularly where the component does not require an electrical connection, for example in the case of a picture frame or a wireless doorbell.

Figure 4A:
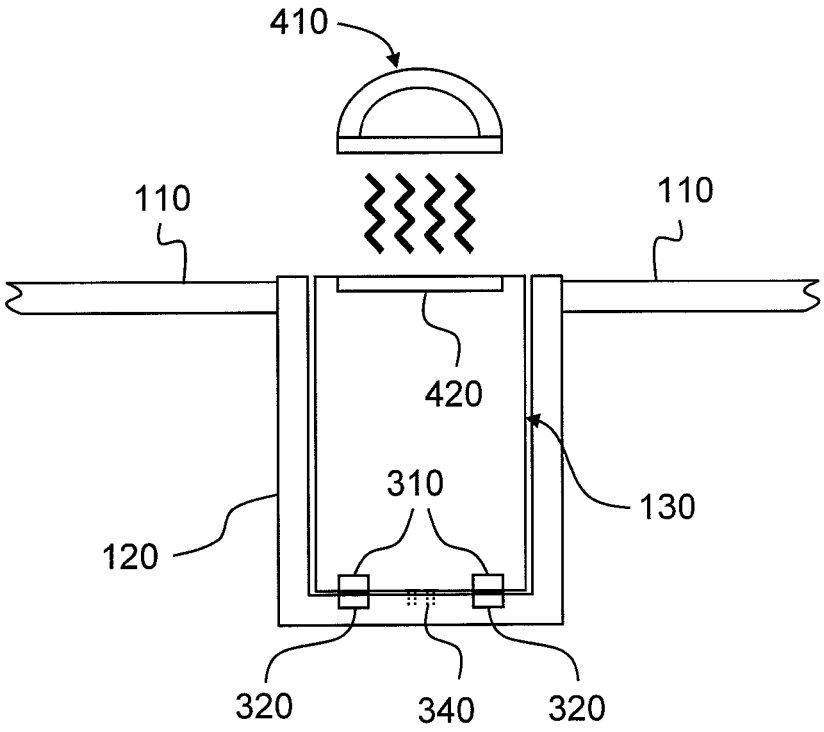
FIGS. 4A-4B are horizontal cross sections of a component that is pulled out of a receiver by applying a magnetic gripper to the front of the component.
Figure 4B:
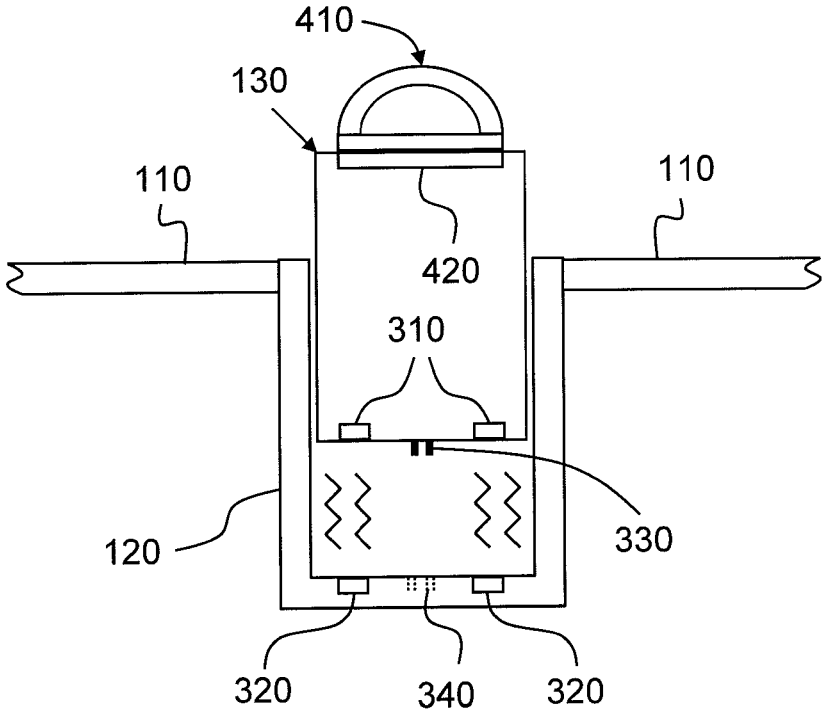

In FIGS. 4A and 4B, instead of using an electromagnet of reversed polarities to eject the component from the receiver, a magnet gripper 410 could be used with a magnet attractor 420 to overpower the magnetic force between magnet attractor 310 and magnet 320. It should be appreciated that the magnetic force between magnet gripper 410 and magnet attractor 420 should be much stronger than the magnetic force between magnet attractor 310 and magnet 320. It should also be appreciated that if component 130 is an electronic device, that magnet attractors 310 and 420 should be located well aware of any electrical machinery that would be negatively affected by a strong magnetic force. An additional magnet gripper (not shown), or a single magnet gripper with an additional handle, could be used for a user to pull the component out of the receiver with two hands instead of one.

Figure 5A:
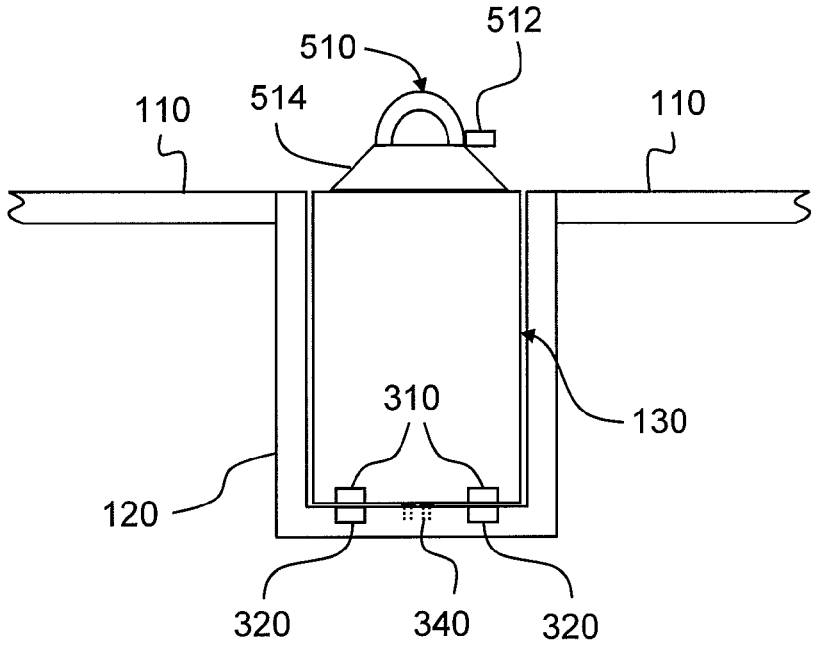
FIGS. 5A-5B are horizontal cross sections of a component that is pulled out of a receiver by applying a vacuum gripper to the front of the component.
Figure 5B:
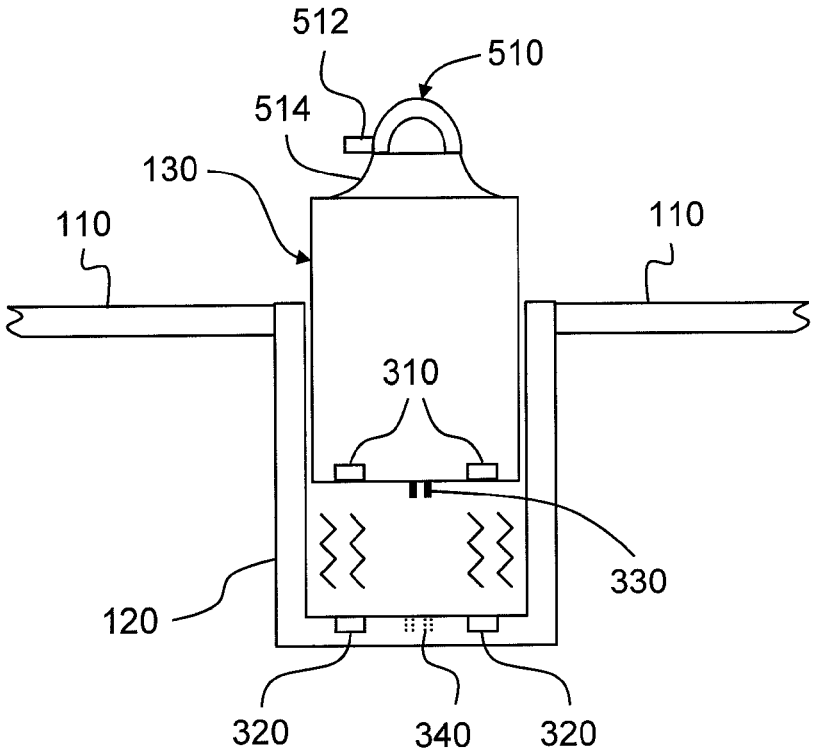

In FIGS. 5A and 5B, a vacuum gripper 510 is used instead of a magnet gripper to overpower the magnetic force between magnet attractor 310 and magnet 320. Vacuum gripper has a lever 512 that is attached to suction cup 514 such that when lever 512 is activated, air is removed from suction cup 514. When lever 512 is pulled while suction cup 514 abuts the flat surface of component 130, the absence of air in suction cup 514 provides a vacuum force that locks vacuum gripper 510 to the front of component 130. From that point, a user can simply pull on vacuum gripper 510 to remove component 130 from receiver 120.

Figure 6:
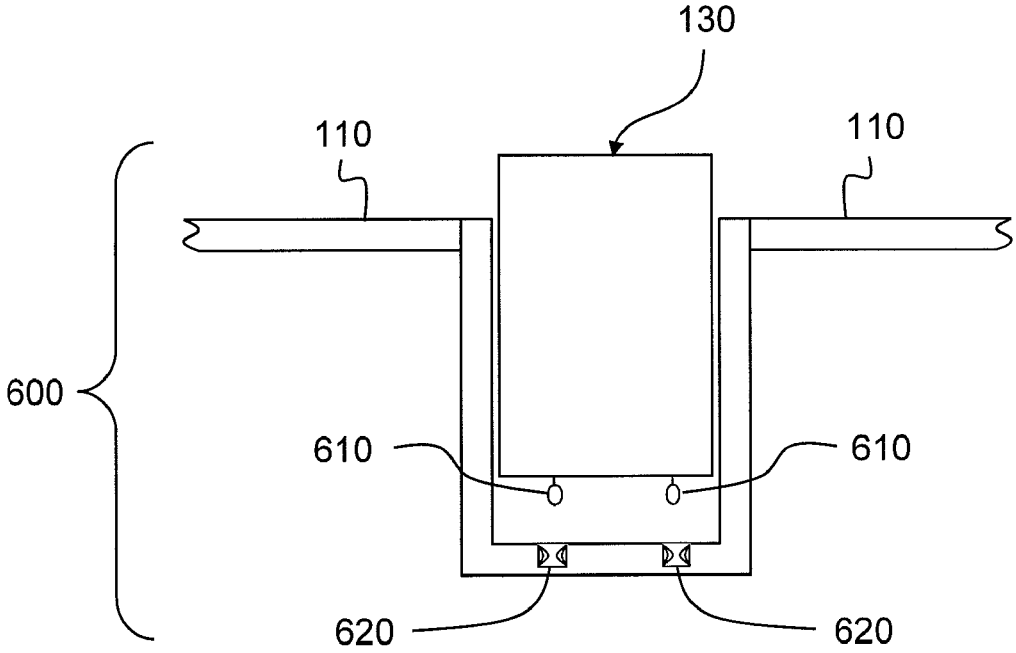
FIG. 6 is a horizontal cross section of a component and receiver that lock using matching indents and detents.

In FIG. 6, an indent/detent locking mechanism 600 generally comprises indents 610 and detents 620. Indents 610 are sized, spaced, and oriented to mate with detents 620 as component 130 is being inserted into receiver 120. Preferably, detents snap into place around indents 610 without locking into place, so that component 130 can be pulled out of receiver 120 without damaging the indent/detent mating. Detent 620 could also be a push-push latch, so that component 130 could be disengaged merely by pressing on the front of component 130. In a preferred embodiment, indents 610 are male banana jacks and detents 620 are female banana jacks that provide an electrical communication between component 130 and receiver 120 and a locking mechanism between component 130 and receiver 120.

Figure 7:
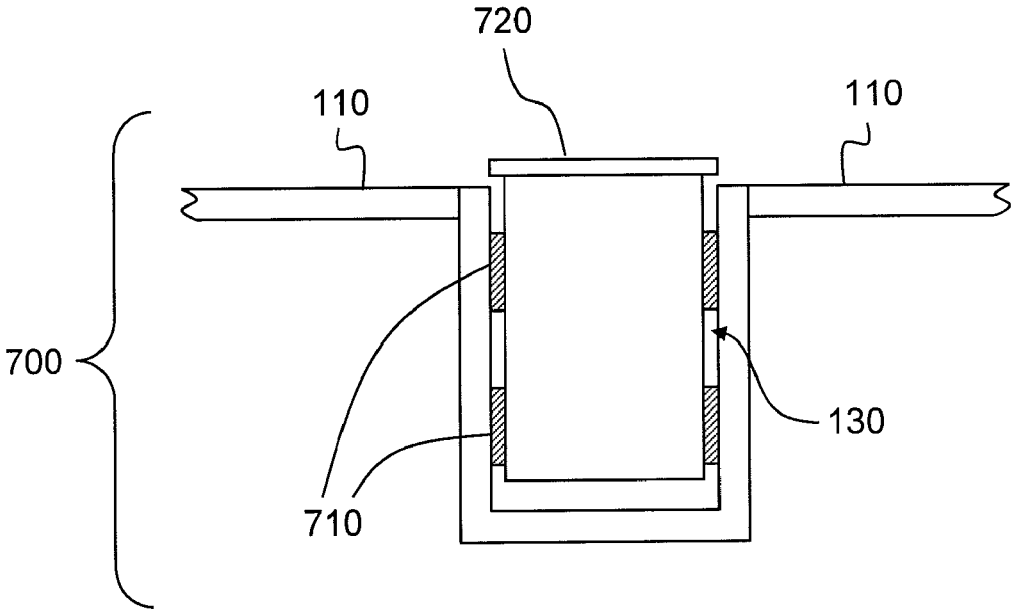
FIG. 7 is a horizontal cross section of a component and receiver that lock using compressible material lining the receiver

In FIG. 7, a compressible locking mechanism 700 generally comprises a compressible material 710 that fits in the gap between the rear portion of component 130 and the receiver 120. Compressible material 710 is preferably an elastic polymer or fabric that has a tendency to return to its own shape. The combined elastic forces of compressible material 710 and the vacuum force of pushing air out of receiver 120 holds component 720 in place within receiver 120. In this particular example, the outside face plate 720 is larger than the rear portion of component 130.

Figure 8A:
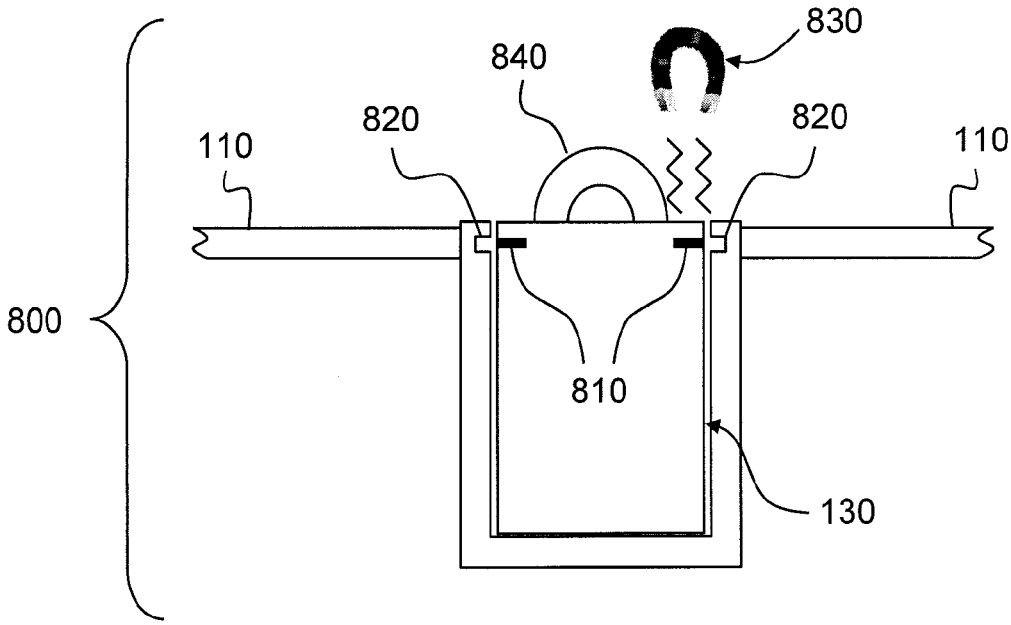
FIG. 8A-8B is a horizontal cross section of a component and receiver that lock using matching sliding bolts and recesses.
Figure 8B:
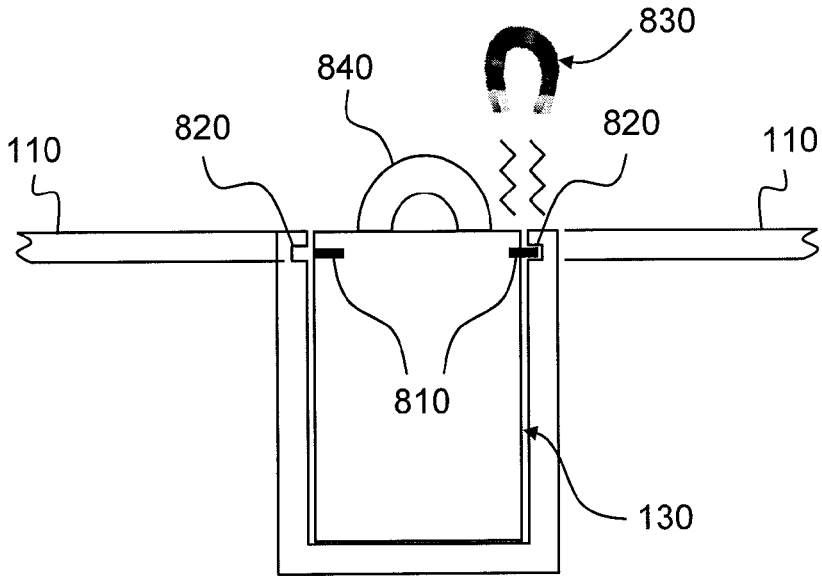
Figure 9A:
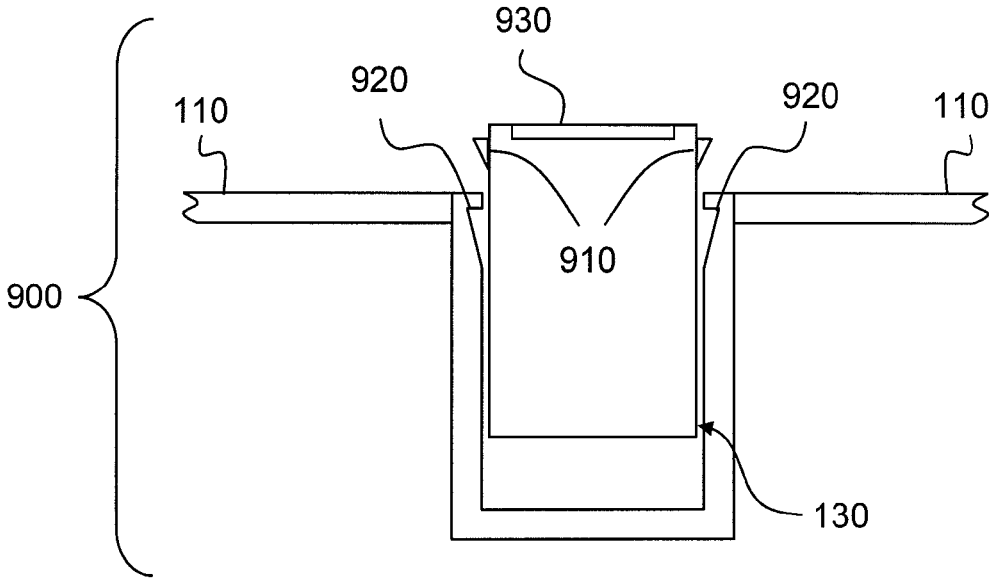
FIG. 9A-9D is a horizontal cross section of a component and receiver that lock using matching pivoting latches and protrusions.
Figure 9B:
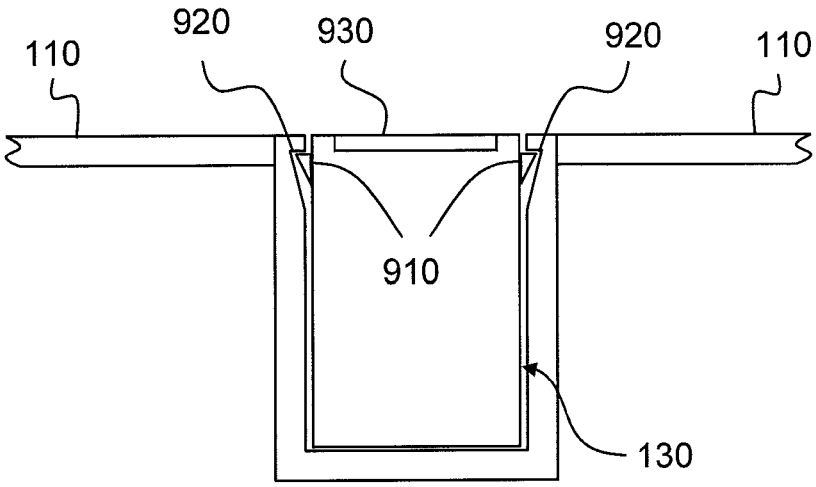
Figure 9C:
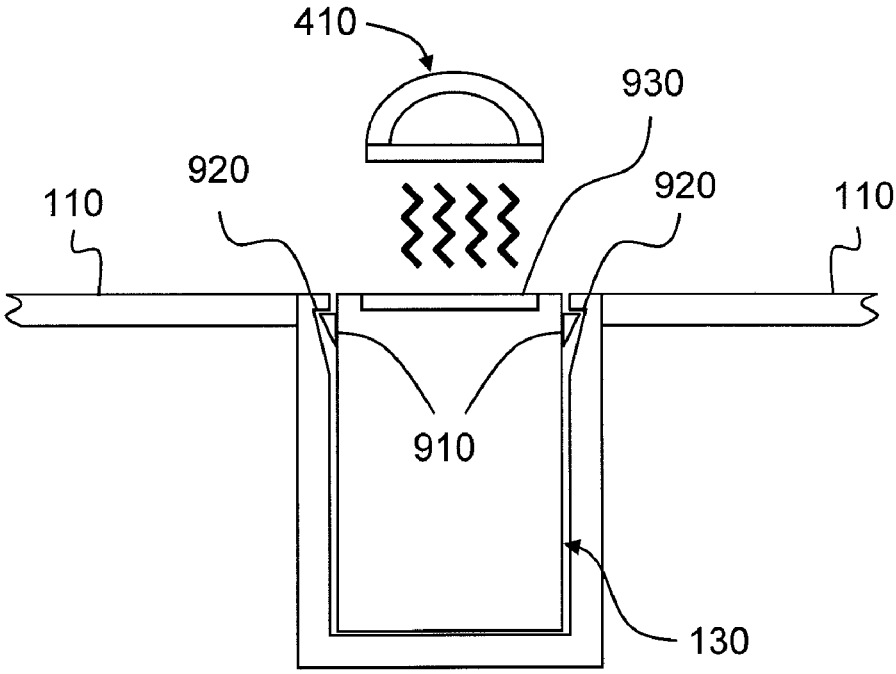
Figure 9D:
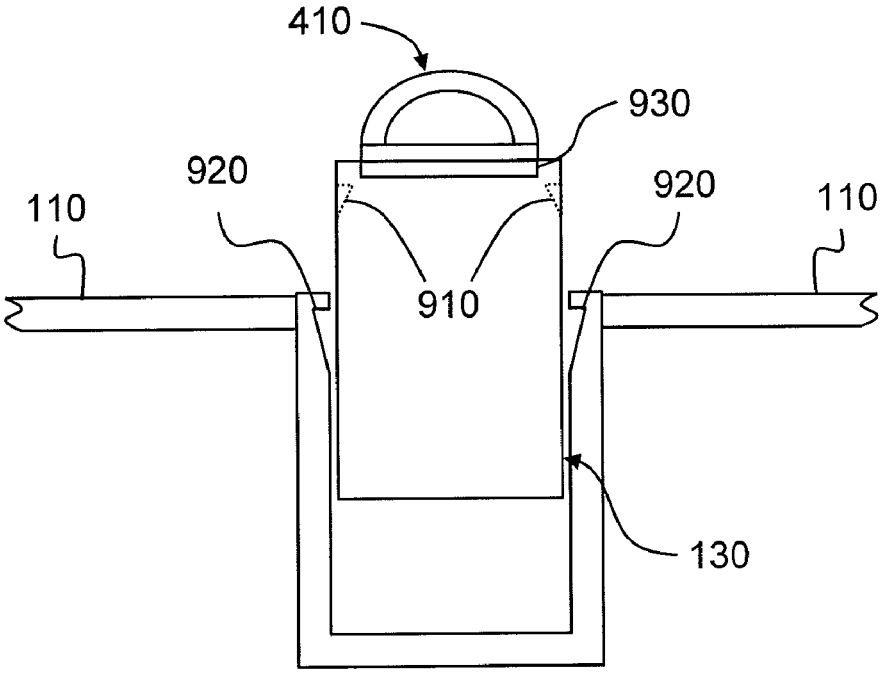

In FIG. 8, a sliding bolt locking mechanism 800 generally comprises sliding bolts 810 in component 130 and recesses 820 in receiver 120. Sliding bolt 810 is a magnet attractor that is pulled into place by drawing magnet 830 across the surface of component 130. In this particular example, component 130 has a handle 840 that extends from a front surface of component 130 to allow a user to pull component 130 away from receiver 120 once the sliding bolt mechanism is unlocked.

In FIGS. 9A-9D, a pivoting latch locking mechanism 900 generally comprises pivoting latches 910 in component 130, latch lock 920 in receiver 120, and magnet attractor 930 in component 130. As component 130 is inserted into receiver 120, pivoting latches 910 pivot into a recess (not shown) in component 130 and then snap into latch locks 920, preventing component 130 from being pulled out of receiver 120. Latch lock 920 is shown as a beveled recess, but could be a protrusion or any other suitable latch lock that prevents component 130 from being pulled out of receiver 120. Here, pivoting latches 910 are also made of a magnet attracting material. When magnet gripper 410 is applied to magnet attractor 930, magnet attractor 930 acts as a magnet, pulling latches 910 out of latch locks 920, so that component 130 can then be pulled out of receiver 120.

Figure 10A:
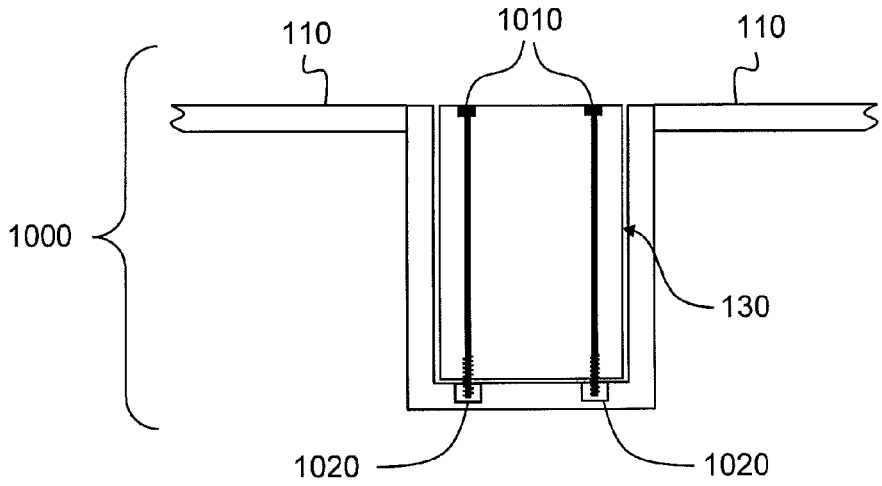
FIG. 10A is a horizontal cross section of a component and receiver that lock using matching threaded bolts and threaded holes.
Figure 10B:
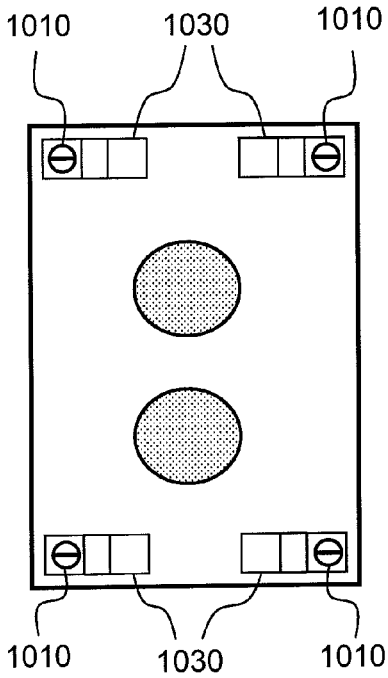
FIG. 10B-10C are front plan views of the component of FIG. 10A.
Figure 10C:
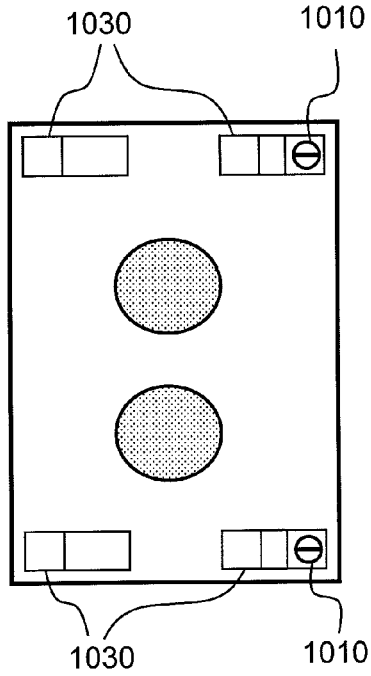

In FIGS. 10A-10C, a screw locking mechanism 1000 generally comprises screws 1010, screw holes 1020 in receiver 120, and a cover 1030. Screws 1010 are threaded and run through the entirety of component 130 and into screw holes 1020 to hold component 130 against receiver 120. It should be appreciated that screws 1010 could also be angled towards a closer wall of receiver 120, or could be fully threaded along the entire length of the screw. As seen in FIG. 10B, the heads of screws 1010 are visible from the front of component 130. Thus, after installation, cover 1030 is positioned in the recess, and magnetically, mechanically or otherwise held in place to provide an even front surface to component 130.

Figure 10D:
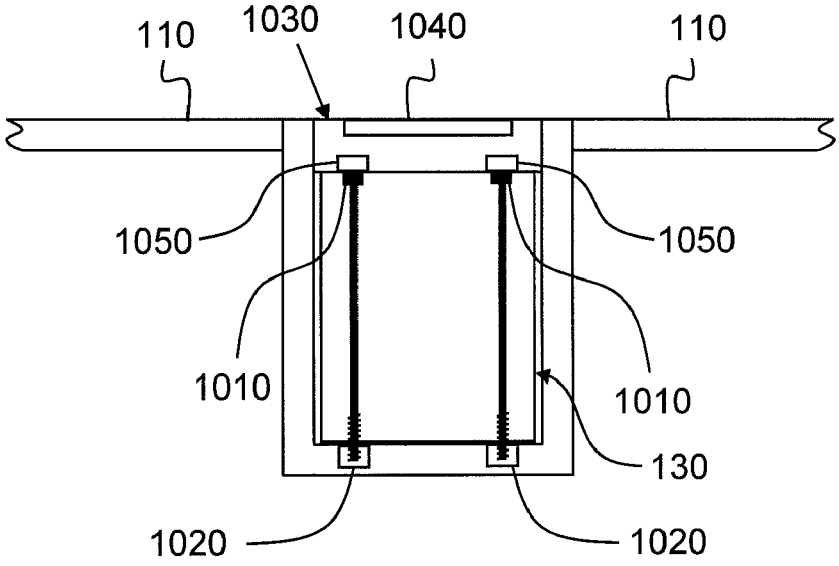
FIG. 10D-10F are horizontal cross section views of a shortened component and receiver of FIG. 10A, with a magnetic faceplate attached.
Figure 10E:
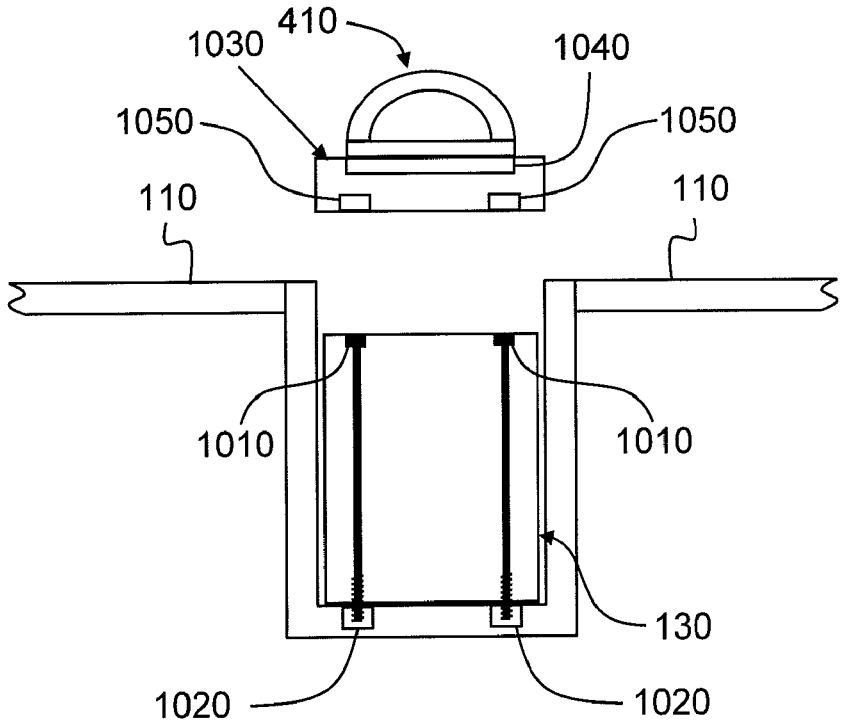

In FIGS. 10D-10E, the screw locking mechanism 1000 also has a magnetic faceplate 1030 with magnet attractor 1040 and magnets 1050. Magnets 1050 hold the faceplate against component 130 by coupling to the heads of screws 1010. It should be appreciated that component 130 could comprise other magnet attractors that help couple the magnetic faceplate to the component. Faceplate 1030 could be removed with either a magnet gripper 410 or another suitable gripping device, for example a vacuum gripper.

Figure 10F:
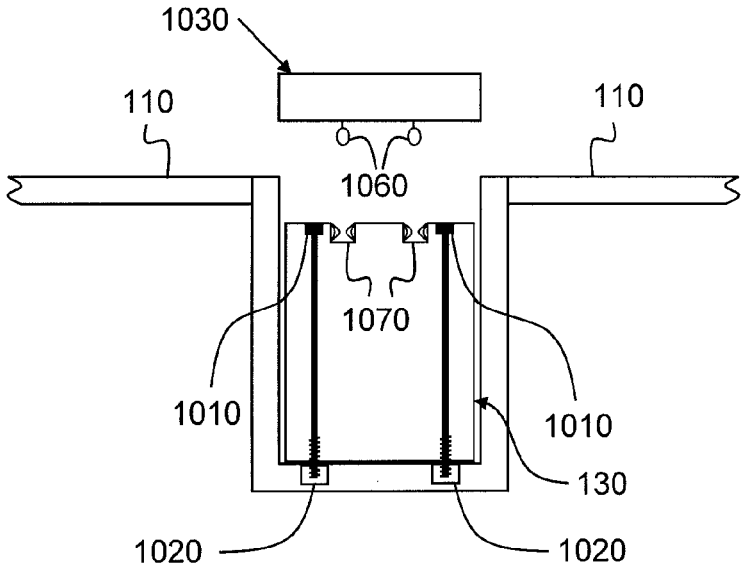

As shown in FIG. 10F, faceplate 1030 could also be held in place and removed using matching indents 1060 and spring detents 1070 to form a push-push mechanical coupling. While the faceplate coupling also preferably conceals the locking mechanism, all other suitable couplings are contemplated.

Figure 11:
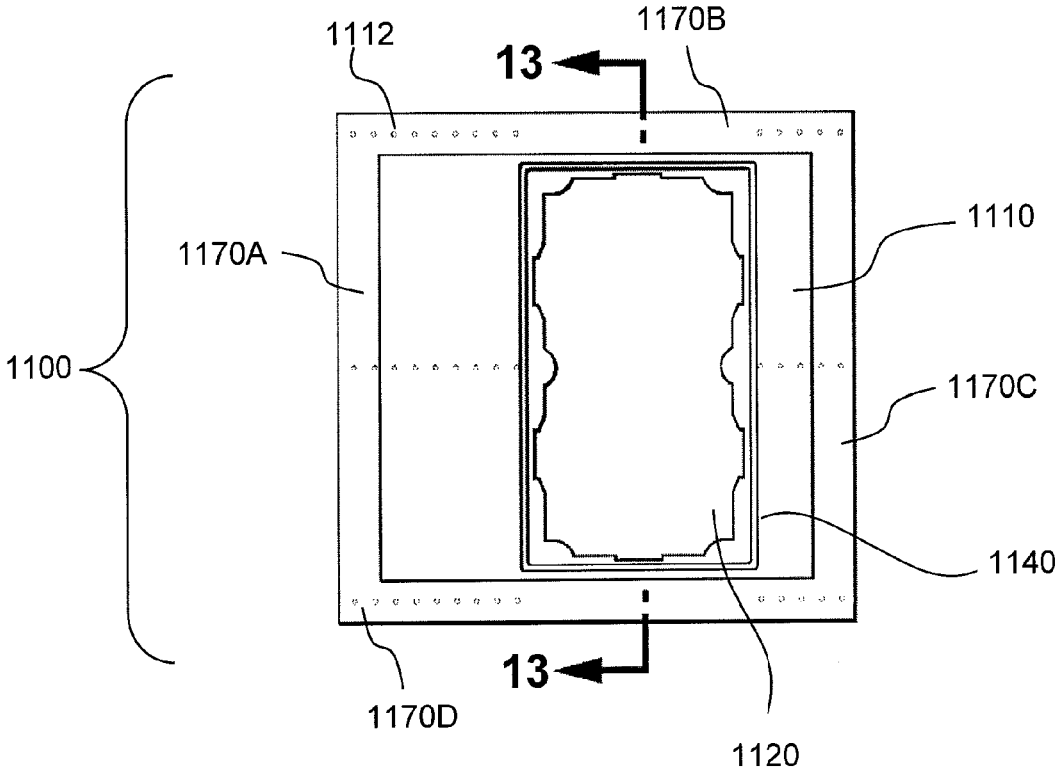
FIG. 11 is a plan view of a panel having an opening, and a receiver disposed in the opening.

In all of the embodiments, the receiver is preferably preinstalled in a panel that is then installed in a wallboard to provide better support for the component. In FIG. 11, a component mounting apparatus 1100 generally includes a panel 1110 with an opening 1120, and a receiver 1140 disposed in the opening 1120, and attachment wings 1170A-1170D. It should be appreciated that while each receiver is sized and dimensioned to hold a specific component, the receivers could be identical to one another to create a "universal bracketing system" that can hold components of various sizes.

Panel 1110 is a piece of gypsum board, wood, plastic, or other material (or combination of materials) sufficiently strong to support a speaker or other desired component between two studs of a wall, or joists or other supports in a ceiling. Where plywood is used as the panel material, for example, the panel might be as thin as ¼" (6.35 mm), but would more preferably measure at least ½" (12.7 mm) or ⅜" (19.05 mm). Preferred materials include wallboard, Medium Density Fiberboard (MDF), High Density Fiberboard (MDF), Acrylonitrile Butadiene Styrene (ABS), and other materials that closely match various characteristics of drywall. Multiple materials could be used, for example mixed in with one another, alternating, layered on top of one another, or a combination. Preferably, the material has equal moisture absorption and coefficient of thermal expansion as the surrounding wallboard, while having greater durability and strength for attaching heavy components directly to the panel. For example QuietRock® 525 could be a paneling material used where the wallboard comprises drywall.

Panel 1110 is generally about twenty inches (about 50 cm) to twenty-four inches (about 60 cm) wide, but panel 1110 can have any other suitable dimensions, even for example, up to the size to replace an entire sheet of wallboard. Narrower panels are also contemplated, although they would likely not have a sufficient width to extend between wall studs or ceiling joists. It is preferable for the panel 1110 to have a width of at least six inches (15.24 cm) or twelve inches (30.48 cm) greater than the spacing between studs, which allows the installer considerably greater flexibility in positioning the panel on the wall. Lateral wings (not shown) could be attached to the perimeter of panel 1110 to extend the width for installations where the studs are spread apart at a greater distance from each other than normal. While panel 1110 is shown as a substantially planar apparatus, panel 1110 can be concave, convex, or any other shape to either match the shape of the wallboard, or to introduce a non-planar surface to the wallboard.

Hole primers 1112 are spaced approximately 1 inch (2.5 cm) from center, a diameter of 0.375 in (9.525 mm), and are approximately ¼ in (6.35 mm) deep, but can be shaped and configured in other suitable ways. A "hole primer" is a concave hole deepest in the center that helps an installer drill a screw or hammer a nail in a designated place without slipping. The diameter of the hole primer is preferably larger than the diameter of the screw head or nail head used so as to prevent the head of the screw or nail from leaving an unsightly bump on the surface of the wallboard after spackling. Other suitable receivers are contemplated, for example visual marks or predrilled and threaded screw holes.

Opening 1120 can also be of any suitable shape and size. Preferred openings are rectangular to accommodate common rectangular components, for example light switches, wall outlets, speaker volume controls, and home security systems. However, the openings could also be oval or circular or any other desired shape. The area of the opening is generally dependent on the size of the component, and can range up to 80 $in^2$ or larger. Especially preferred openings have an area of at least 20 $in^2$, 40 $in^2$, 60 $in^2$, and even 80 $in^2$. Nevertheless, for stability, it is contemplated that the panel have openings with a length that is no more than half or one third the length of the panel.

In some cases it may be desirable to include multiple openings for multiple components. Openings with varying height could be aligned along their top or bottom edges, aligned along a centerline, or could be arranged in a staircase fashion with a top edge aligned to a bottom edge. Openings could be cut at a job site or elsewhere by an installer, but are more conveniently precut (or molded to include the opening) at the manufacturer. It is possible for a panel to have punch out openings or perhaps cutout lines to facilitate selection of the position of the opening at the job site, but those options are currently disfavored relative to a manufactured pre-cut or molded opening and a relatively large panel.

The top, bottom, and side wings 1170A-1170D, respectively, preferably extend from the corresponding edges of the panel 1110 by at least about one inch (2.54 cm), which is deemed to be sufficient space to conveniently drive a nail or screw into a stud. It is also contemplated, however, that at least one of the wings 1170A-170D can extend much longer, perhaps 24 to 30 inches (about 60-75 cm) or more. Such long wings can accommodate odd installations where the studs are spread apart at a greater distance from each other than normal. Wings 1170A-1170D are preferably made of a metal mesh, but can include of any suitable material or materials so long as the material(s) provide(s) sufficient shear strength to support the panel 1110 and the component (not shown). Metal mesh is also desirable because the wings are advantageously relatively thin, so as not to push out the overlying wallboard, and metals can provide considerable strength with thickness of less than 100 mils. It should also be appreciated that although wings 1170A-1170D are described herein by separate numerals, they may well be one continuous piece of material.

Figure 12:
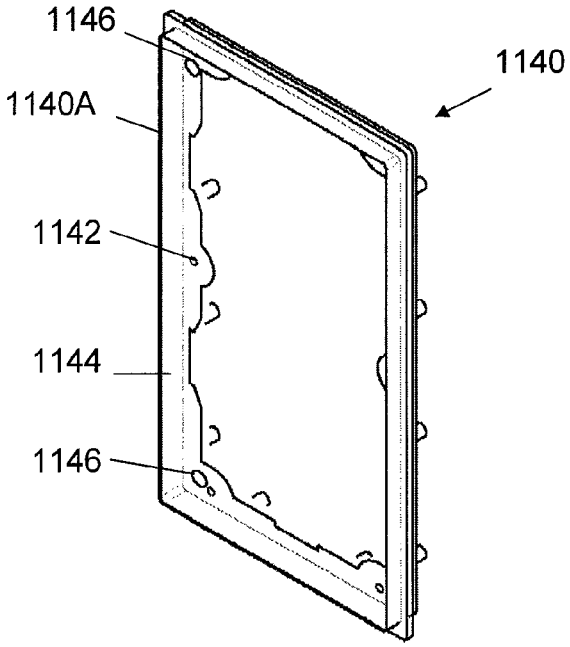
FIG. 12 is a front perspective view of the receiver in FIG. 11.

Receiver 1140 is preferably sized and dimensioned to fit snugly into opening 1120, but in any event is screwed, glued, clamped, or are otherwise securely attached to the panel 1110. The secure attachment is important since in at least some embodiments, the component housing will be attached to the receiver rather than being directly attached to the panel 1110. The receiver is preferably molded from polyethylene or other sufficiently strong and durable thermoset plastic. A front of receiver 1140 is shown in greater detail in FIG. 12, and includes holes 1142 for screws (not shown), a recess 1144 into which a component cover (not shown) can be removably secured via a holding mechanism, and a rim 1140A, and optional magnets 1146 or an optional press fit (not shown).

A spackle shield (not shown) preferably covers the opening of the receiver to prevent mud or drywall from splashing to the other side of the panel, and can be removed after spackling. This is particularly helpful for when an electronic component is pre-installed behind the panel before spackling. The spackle shield (not shown) can have optional level (not shown) to help ensure that the panel is being installed horizontally. Other devices that assist in installation can be provided in the spackle shield, for example a laser leveler to help align several panels with one another or a compartment that stores extra screws and magnets.

Figure 13A:
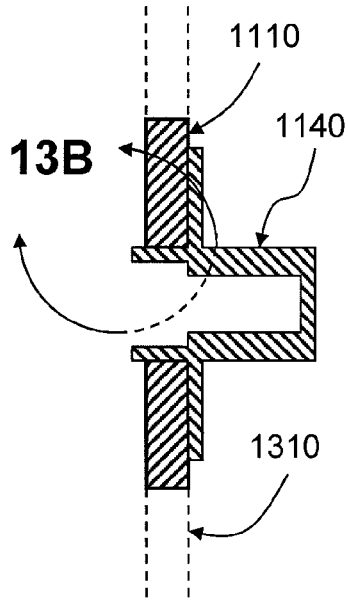
FIG. 13A is a simplified vertical cross-section of the panel of FIG. 11, taken along line 13-13, installed in a wallboard with an attached component.
Figure 13B:
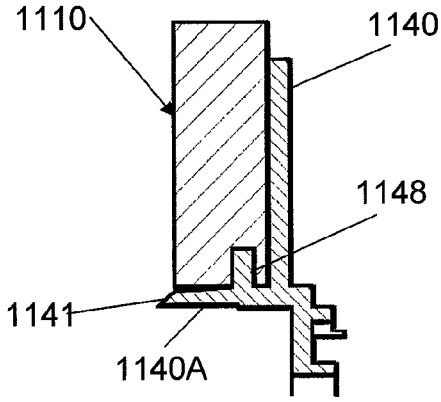
FIG. 13B is a blown up view of the circled portion of FIG. 13, taken along line 14-14.

FIG. 13A-B shows a side view of panel 1110 and receiver 1140. The rim 1140A is sized and dimensioned to extend outwardly beyond a front of the panel 1110 by a very small distance 1141, which provides a lip that can readily be used as a stop against which to spread a spackling compound, for example plaster or drywall. Preferred such distances 1141 are less than ⅛ inch, and preferably about 1/16 inch, or in metric terms about 1-3 mm. Preferably, the panel has a thickness of at least ¼ inch (6.35 mm). Also shown in FIG. 13B is an attachment member 1148 that helps secure receiver 1140 to panel 1110. A screw hole (not shown) can be provided in attachment member 1148 to help affix receiver 1140 to panel 1110.

It should be appreciated that the rim could be separable from the panel. Thus, for example, the rim could be a separately molded piece of plastic, metal or composite that is installed into the opening by the installer, or at a factory.

Figure 14:
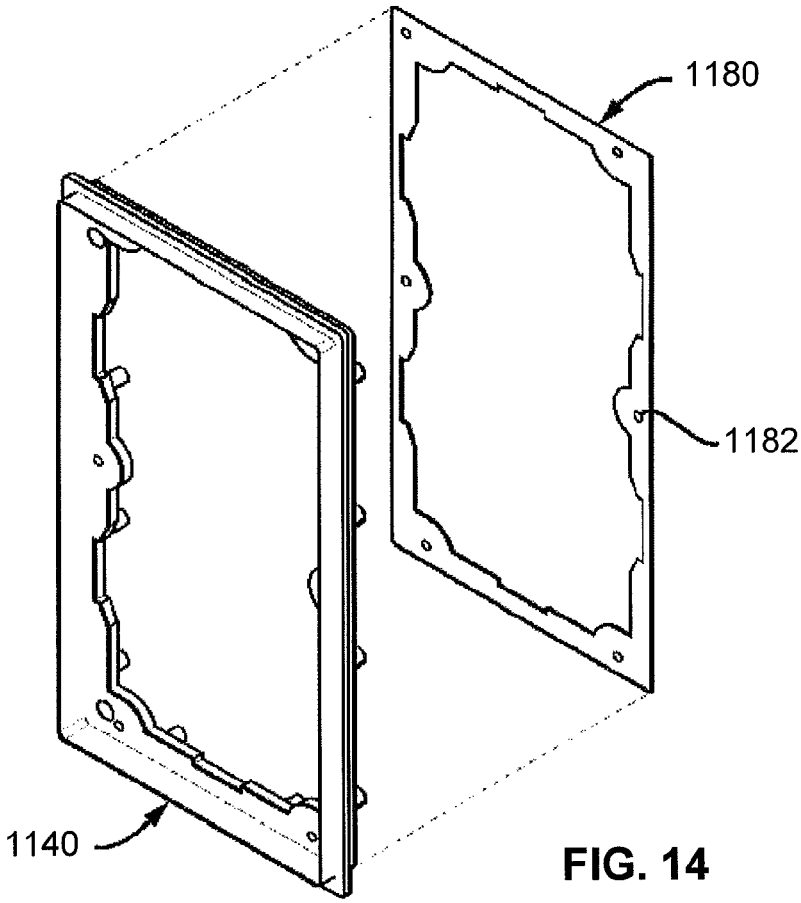
FIG. 14 is a front perspective view of the receiver of FIG. 12 positioned to couple with a bracket backing.
Figure 15:
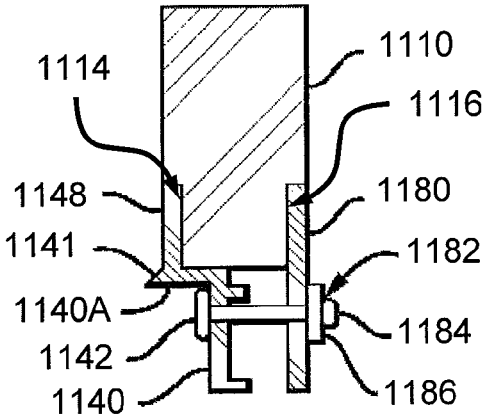
FIG. 15 is a blown up view of the circled portion of FIG. 13, taken along 14-14, with the bracket and bracket backing of FIG. 15.

As seen in FIGS. 14 and 15, a receiver backing 1180 with screw holes 1182 could be used to clamp receiver 1140 to panel 1110. In this embodiment, attachment member 1148 fits within recess 1114 on the front of panel 1110 and receiver backing 1180 fits within recess 1116 on the back of panel 1110. Screw 1184 threads through screw holes 1142 and 1182, and finally through nut 1186 to provide a clamping force around panel 1110. Clamping receiver 1140 to panel 1110 provides a secure connection without the need for expensive glues or adhesives.

Figure 16A:
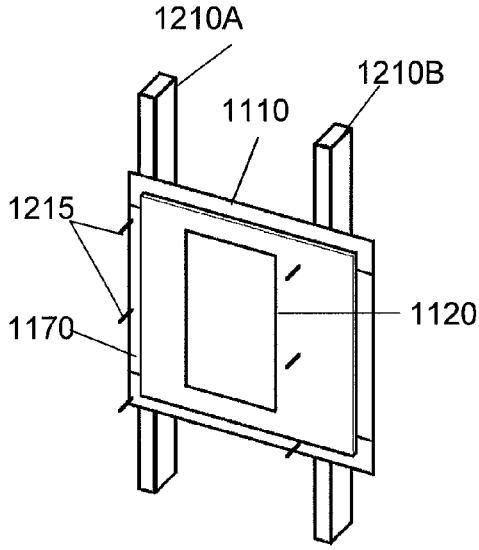
FIG. 16A is a front perspective view of a panel being affixed to two studs in a wall, the panel having a spackle shield covering the openings.

In FIG. 16A, the panel 1110 is affixed to two studs 1210A, 1210B in a wall, and screws 1215 are inserted through hole primers 1112 and the panel 1110 on the right side, and through attached flange 1170. Panel 1110 shows opening 1120 with a spackle shield covering the receiver. Of course, the positioning and orientation of the panel could be varied in any suitable manner with respect to the studs, 1210A, 1210B, including moving the panel 1110 higher or lower, left or right, or even tilting the panel clockwise or counterclockwise. Similarly, the studs should also be interpreted herein as emblematic of any support structures of a wall, whether or not such structures are technically considered to be studs. In addition, a greater or lesser number of screws could be used, or inserted in some other arrangement than that shown to provide greater or lesser support. The screws could also be replaced or supplemented by some other attachment means such as an adhesive.

Those skilled in the art will appreciate that the combination of panel and receiver could be provided in several different ways. The panel and receiver could, for example, be joined together at a job site, and indeed the panel could even be "manufactured" at the job site by cutting or punching out the opening. More preferably, however, the panel and receiver are provided as an item of manufacture to the installer by a supplier or manufacturer. The rim of the panel can be pre-installed to the panel. Thus, in various embodiments a kit could contain one or more of a panel, a receiver (or at least a rim around the edges of an opening in the panel), a speaker housing, a spackle shield, and installation screws. The installer would then provide whatever labor is appropriate for the installation, including optionally installing the receiver and/or rim, optionally installing the spackle shield, and optionally mounting the speaker into the speaker housing to the back side of the panel. It is also contemplated that the speaker can be pre-installed into the panel before installation. Alternatively the combination of the panel and receiver can be mounted before installing a rim on the opening.

Figure 16B:
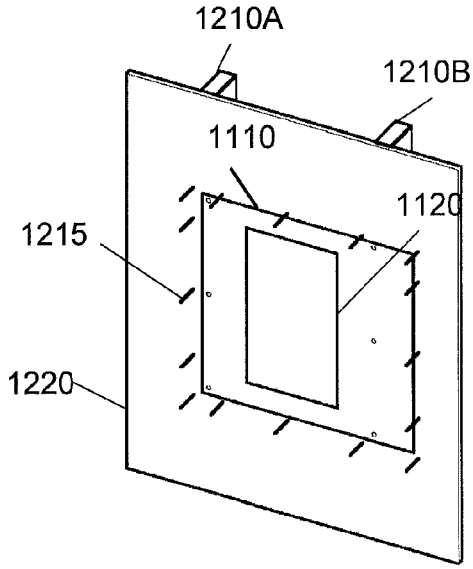
FIG. 16B is a front perspective view of the panel of FIG. 17A, around which drywall has been installed.

In FIG. 16B drywall 1220 or other wallboard has been installed on all four sides around the panel 1110, and coupled to the wings using screws 1215. Where wings are present, as in the embodiment depicted, the drywall 1220 overlays the wings, but the wings are sufficiently thin so that the drywall is not noticeable raised. Those skilled in the art will appreciate that although FIG. 16B shows the drywall 1220 surrounding the panel 1110 as a single piece; it is entirely possible that the drywall could comprise multiple pieces (not shown). It is also contemplated that installation of the drywall 1220 might be delegated to drywaller or other tradesman distinct from the panel installer. Nevertheless, the process of installing the panel on one or more wall supports is deemed to include the step of positioning the panel so that it can be approximated in an end-to-end fashion by a piece of wallboard or other wall section.

Figure 16C:
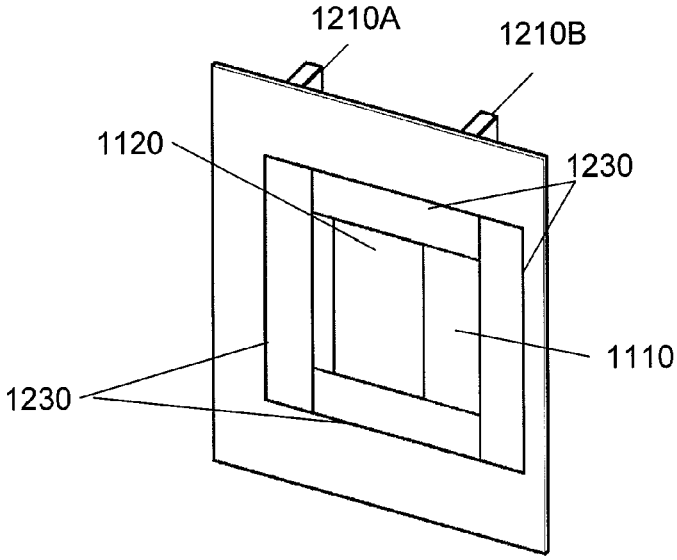
FIG. 16C is a front perspective view of the panel and drywall of FIG. 17B, showing mesh tape.

In FIG. 16C mesh tape 1230 is applied along the juxtapositions or other approximations between edges of the panel 1110 and edges of the drywall 1220. Here again, this step is usually delegated to a professional drywaller, but could be accomplished by the installer of the panel, regardless of which person actually does the work.

Figure 16D:
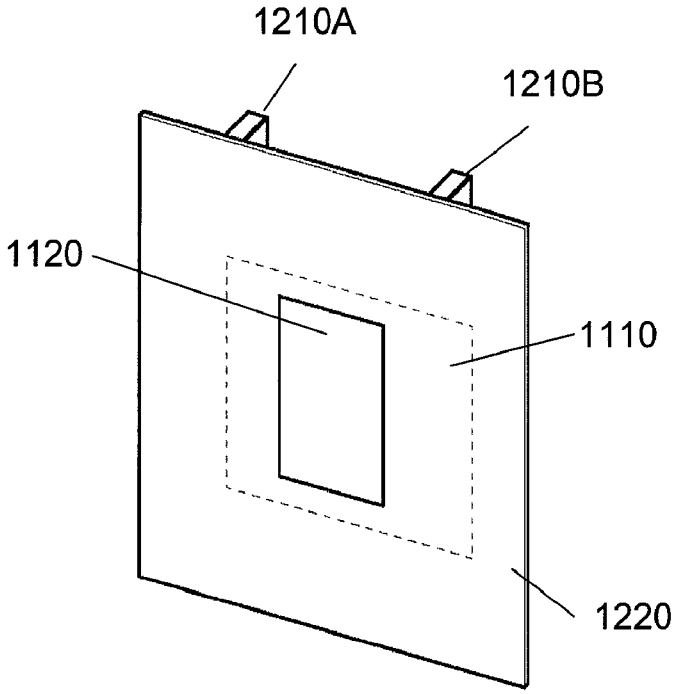
FIG. 16D is a front perspective view of the panel and drywall of FIG. 17C, where the mesh tape has been covered by spackle.
Figure 16E:
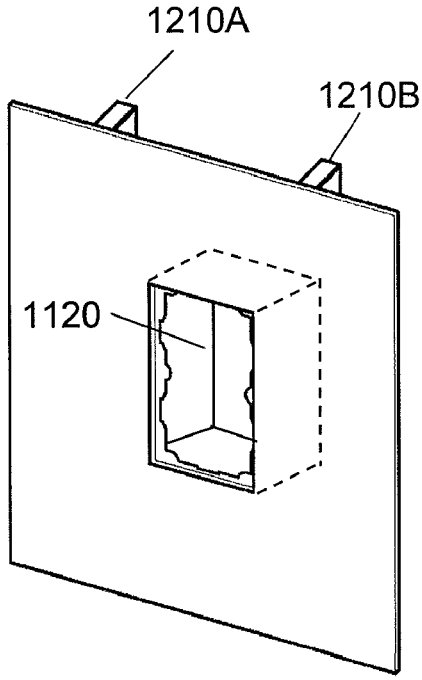
FIG. 16E is a front perspective view of the panel and drywall of FIG. 17C, where the spackle shields have been removed to show the openings.

In FIG. 16D the mesh tape is covered by a spackling compound, and is ready for painting, wallpapering, or other surface coating. Preferably, the spackling compound is smoothed over the entire front surface of the panel to the lips of opening 1120. As used herein, the terms "spackle" and "spackling" should be interpreted as broadly as possible, to include for example plaster and plastering of any type. One objective is to provide a smoothed out surface that completely or substantially hides the joints between edges of the panel and edges of the drywall In FIG. 16E, the spackle shield is removed from opening 1120 and a component can be installed in the new uniform wallboard 1220.

Figure 17A:
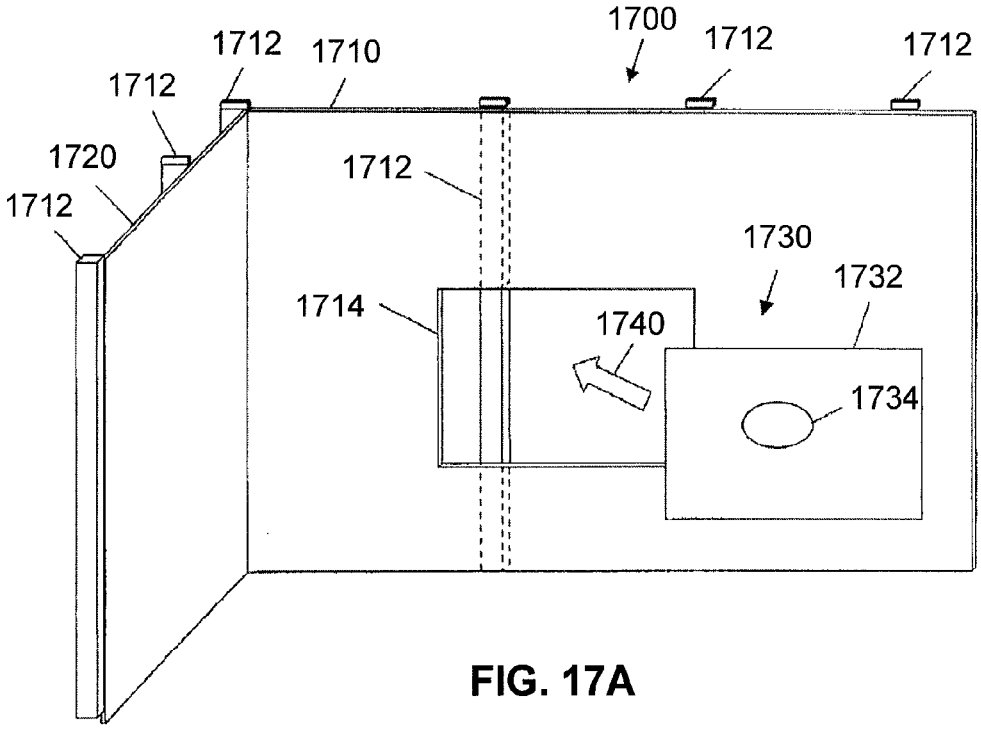
FIG. 17A is a perspective view of two structures in a building (e.g. walls or wall and ceiling), in which an opening has been cut to receive a panel assembly.

In FIG. 17A an installation 1700 generally includes wallboards 1710, 1720, an opening 1714 on structure 1710, and a panel assembly 1730 that will installed into the space 1714, as shown by arrow 1740.

Figure 18:
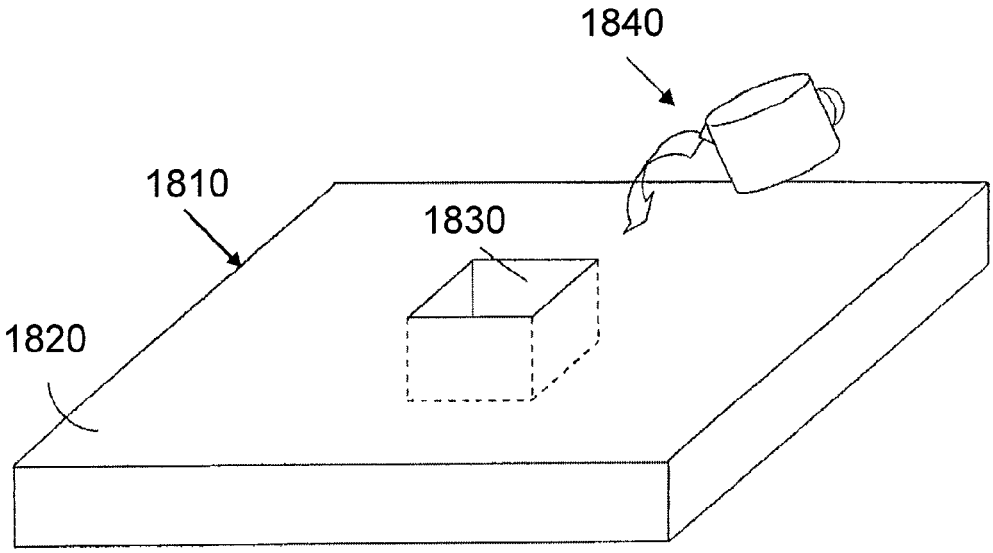
FIG. 18 is a perspective view of a panel assembly being formed by pouring a panel material into a mold.

As used herein, the term "assembly" means an object that has multiple components or functional portions. Thus, the term comprises: (a) multiple pieces that are coupled together in some manner, either temporarily or permanently; and also (b) a single molded object with multiple functional components. By way of example, panel assembly 1810 in FIG. 18 is a panel assembly molded as a single piece.

In typical installations, the wallboards 1710, 1720 would be adjacent vertical walls, or a vertical wall and a ceiling, and FIG. 17A should be interpreted to include all such embodiments. Thus, for example, where wallboards 1710, 1720 are interpreted to be vertical walls, members 1712, 1722 could be studs. Where wallboard 1710 is interpreted as a ceiling, members 1712 could be joists, and members 1722 could be horizontal struts. Although the portions of the wallboards 1710 and 1720 are depicted in the figure as substantially flat, those skilled in the art will appreciate that the structures could be curved, or have curved portions. In addition, those skilled in the art will appreciate that wallboard 1710 could exist independently of wallboard 1720.

Wallboards 1710, 1720 would typically comprise drywall, which term is used herein generically to include all manner of wallboard, fiberboard, gypsum board, GWB, plasterboard, Sheetrock® and Gyproc®, and so forth. Additionally or alternatively, wallboards 1710, 1720 could comprise other materials, including for example polymers, masonry, ceramics, and acoustic ceiling tile materials or other composites.

Wallboards 1710, 1720 can have any suitable dimensions, from only a few square feet or less, to hundreds of square feet or more. Wallboards 1710, 1720 will usually, however, have relatively small thicknesses of between ¼" and 1" in thickness.

Panel assembly 1730 can be produced at a job site, for example, by cutting a hole out of a piece of drywall. The piece being used in such instances can be cut out from an existing vertical wall or ceiling, and or can be completely new to the job site. Either of those methods could work adequately for drywall, acoustic ceiling tile and other materials that are fairly easy to cut, but for difficult to cut materials, including for example polymers, masonry, and ceramics, the panel assembly can be most conveniently produced in a factory where the panel is dried or cured around a form (see FIG. 18) to define the opening.

As discussed above with respect to FIGS. 11-16, the opening 1734 of FIG. 17A can be any suitable size, shape, or number. As currently contemplated, it is desirable that the total front facing area consumed by the opening be relatively small with respect to that of the panel 1732. That ratio is preferably at least 3, more preferably at least five. Viewed from another perspective, it is preferred that the panel 1732 extend in at least one direction at least 3 inches (7.62 cm) from the closest edge of the opening 1734 for light or other simple switches, electrical outlets and so forth, and at least 5 inches (12.7 cm) for lights, more complicated switches and other controllers, speakers and so forth. Where the component has a front-facing surface area of at least 25 $in^2$ (about 160 $cm^2$), the panel 1732 extends in at least one direction at least 12, 117, or even 24 inches (about 30, 45, or 60 cm) from the closest edge of the opening 1734.

Figure 17B:
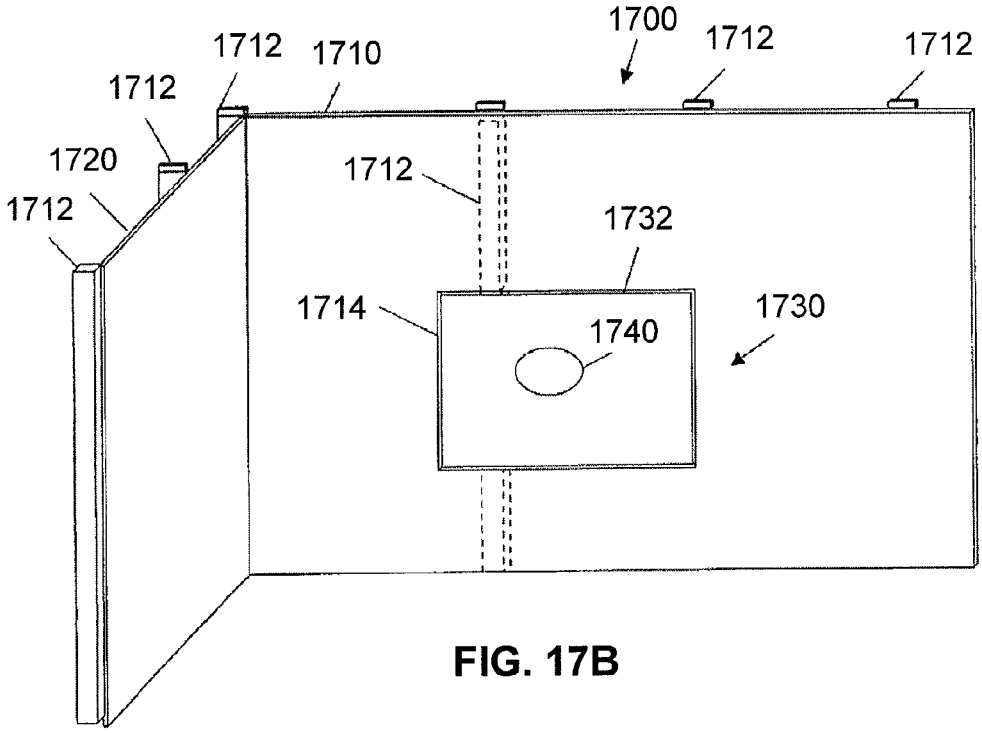
FIG. 17B is a perspective view of the two structures of FIG. 18A, in which the panel assembly has been placed within the opening.

In FIG. 17B the panel assembly 1730 has been placed within the space 1714. There will almost always be some gap between the edges of the panel assembly 1730 and those of the surrounding structural component 1710, ranging in typical installations from zero (where the panel assembly 1730 is abutted against the structural component 1710), and perhaps 1/17" (3.175 mm) to ¼" (6.35 mm). Indeed, there will almost always be multiple different gaps around the edge of the panel assembly. Where the workmanship is sloppy, or the project is especially difficult, the gap in some sections can be larger. In addition, it is contemplated that an intermediate member (not shown), as for example a paper, shim, or even a frame can be installed in the gap between the panel assembly 1730 and the structural component 1710. As long as the edges of the assembly and the wallboard are somewhat near each other, and the gap can be finished and concealed such that an at least superficially continuous junction is established between them, the edges are considered to be approximated.

Figure 17C:
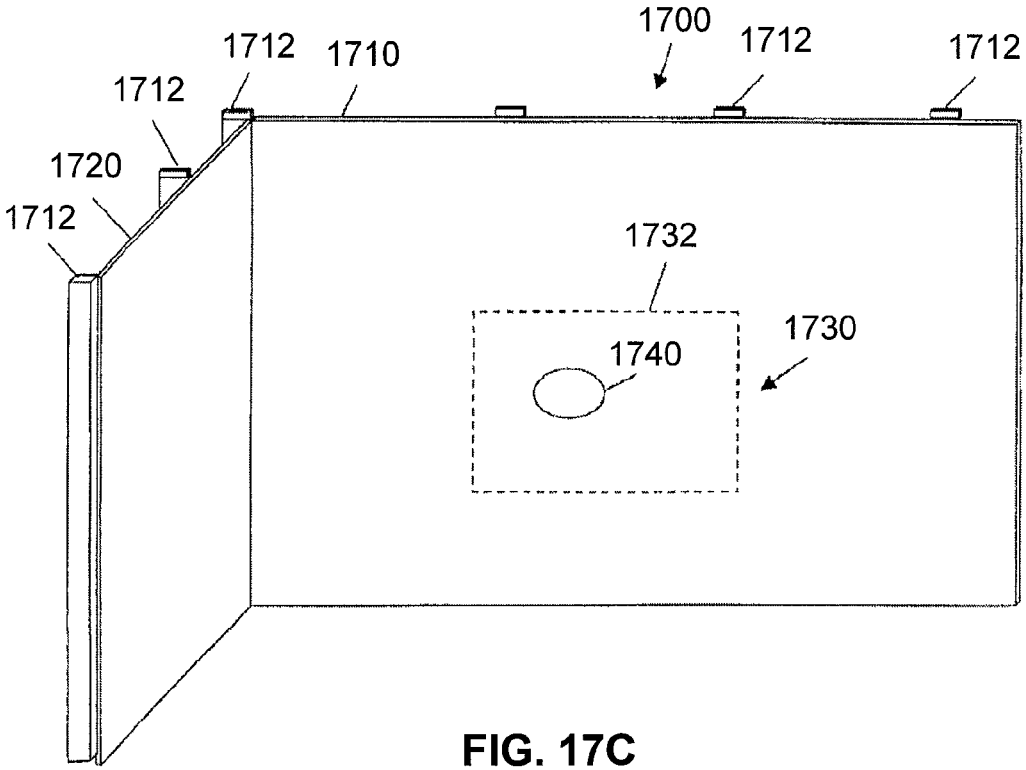
FIG. 17C is a perspective view of the two structures of FIG. 18B, in which the approximated edges of the panel assembly and the wall have been finished to provide a superficially continuous junction.

In FIG. 17C the approximated edges of the panel assembly and the wallboard have been finished to provide an at least superficially continuous junction. As used herein the term "at least superficially continuous junction" refers to a junction that appears to casual observation to be seamless. By way of example, a good workman-like job in taping and plastering adjacent sections of wall board is considered herein to produce an at least superficially continuous junction, especially where subsequent painting or wallpapering eliminates any seam apparent to casual observation.

FIG. 18 is a perspective view of a panel assembly 1810 being formed by pouring a panel material from container 1840 into a mold 1820. This process brings the poured material right up against the frame portion that defines the opening 1830, regardless of any irregularity or other difficulties with the shape of the opening. All manner of panel materials are contemplated, including for example curable plastics, and masonry composites.

Thus, specific embodiments and applications of concealed locking components for wallboard mounts have been disclosed. It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A system for servicing a device mounted in a wallboard, comprising;

a mounted device having a front side and at least one non-front side;

a panel having an opening;

a receiver disposed in the opening and defining an at least partially enclosed space extending from the panel;

a locking mechanism that removably couples the mounted device to the receiver such that the front side of the mounted device is flush with the panel and the at least one non-front side is hidden; and wherein the locking mechanism comprises a first magnet and a first magnet attractor, one of which is disposed on the at least one non-front side of the mounted device and the other of which is disposed on an inner surface of the enclosed space and positioned to magnetically interact to provide a first attraction force.

2. The system of claim 1, wherein the panel is molded around the receiver.

3. The system of claim 1, further comprising a cover.

4. The system of claim 3, wherein the cover comprises a sliding plate that covers the locking mechanism.

5. The system of claim 3, wherein the cover comprises the front side of the mounted device.

6. The system of claim 1, wherein the locking mechanism further comprises a second magnet attractor and a second magnet.

7. The system of claim 1, wherein the locking mechanism comprises an indent and a matching detent.

8. The system of claim 1, wherein the locking mechanism comprises a sliding bolt and a matching recess.

9. The system of claim 1, wherein the locking mechanism comprises a pivoting latch and a matching latch lock.

10. The system of claim 1, wherein the locking mechanism comprises a screw and a matching threaded hole.

11. The system of claim 1, wherein the locking mechanism automatically locks as the device mounts to the receiver.

12. The system of claim 1, wherein the key locks the locking mechanism.

13. The system of claim 1, wherein the key exerts a force that pulls the device from the receiver to unlock the locking mechanism.

14. The system of claim 1, wherein the locking mechanism comprises a magnetic attractor and the key exerts a magnetic force on the magnetic attractor to unlock the locking mechanism.

* * * * *